United States Patent [19]

Mortensen

[11] Patent Number: 4,482,182

[45] Date of Patent: Nov. 13, 1984

[54] MANHOLE LID LIFTER

[76] Inventor: James W. Mortensen, 2147 S. 79th St., West Allis, Wis. 53219

[21] Appl. No.: 463,170

[22] Filed: Feb. 2, 1983

[51] Int. Cl.[3] ..... B66F 11/00

[52] U.S. Cl. ..... 294/15; 254/131

[58] Field of Search ..... 294/17, 15, 16, 62, 294/63 B; 254/131

[56] References Cited

U.S. PATENT DOCUMENTS

| | | | |
|---|---|---|---|
| 370,565 | 9/1887 | Soule | 294/63 B |
| 468,872 | 2/1892 | Hansen et al. | 294/63 B |
| 747,181 | 12/1903 | Jackson et al. | 294/63 B |
| 800,341 | 9/1905 | Tift et al. | 294/63 B |
| 1,933,384 | 10/1933 | Moylan | 294/17 |
| 2,348,978 | 5/1944 | Kinner | 294/26 |
| 2,368,978 | 2/1945 | Fink | 294/16 |
| 2,655,399 | 10/1953 | McMillan | 294/17 |
| 2,832,628 | 4/1958 | Turnbull | 294/17 |
| 3,046,853 | 7/1962 | Legendre | 94/34 |
| 3,436,112 | 4/1969 | Pasquine | 294/62 |
| 3,633,787 | 1/1972 | Katz | 220/43 |
| 4,055,364 | 10/1977 | Breite | 294/63 B |
| 4,076,217 | 2/1978 | Haller et al. | 254/131 |
| 4,101,236 | 7/1978 | Meyer | 404/25 |
| 4,203,686 | 5/1980 | Bowman | 404/25 |
| 4,227,731 | 10/1980 | Castle | 294/17 |
| 4,365,925 | 12/1982 | Girtz | 414/684.3 |

*Primary Examiner*—James B. Marbert

*Attorney, Agent, or Firm*—Quarles & Brady

[57] ABSTRACT

A tool which is suitable for lifting a manhole lid that has spaced attachment notches in its top surface is disclosed. In one embodiment, the tool has a substantially rigid support beam. The beam has a first hook adjacent to its forward end which is adapted to be inserted in one of the notches. The beam also has a pivot attachment point adjacent the rear end of the beam. There is provided a second hook which is mounted on the pivot attachment point, the second hook being adapted to be inserted in a second of the notches upon a pivoting of the hook relative to the beam. The hooks will then act to grip the lid between them. To provide a secure grip on the lid, there is provided a catch which prevents the second hook from pivoting back out of the second notch until the catch is released. This catch automatically locks the second hook in the second notch upon movement of the second hook into the second notch.

5 Claims, 8 Drawing Figures

FIG.5
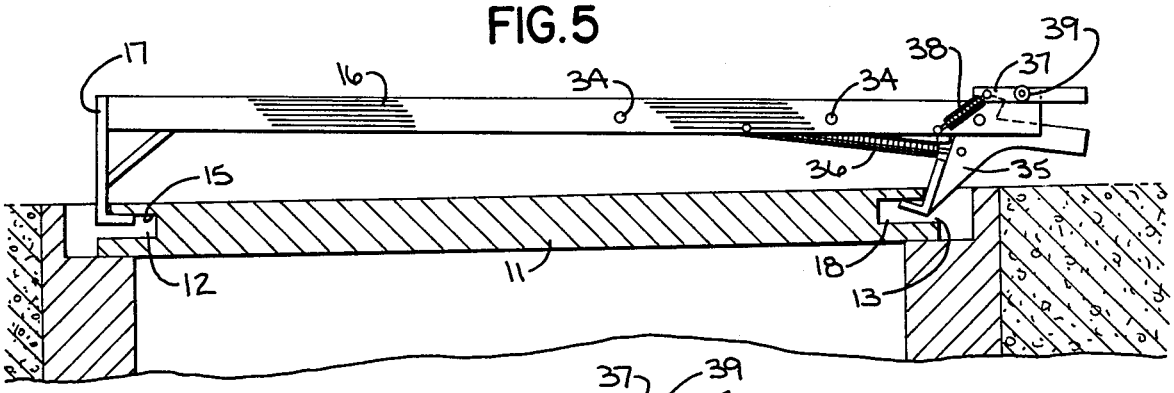
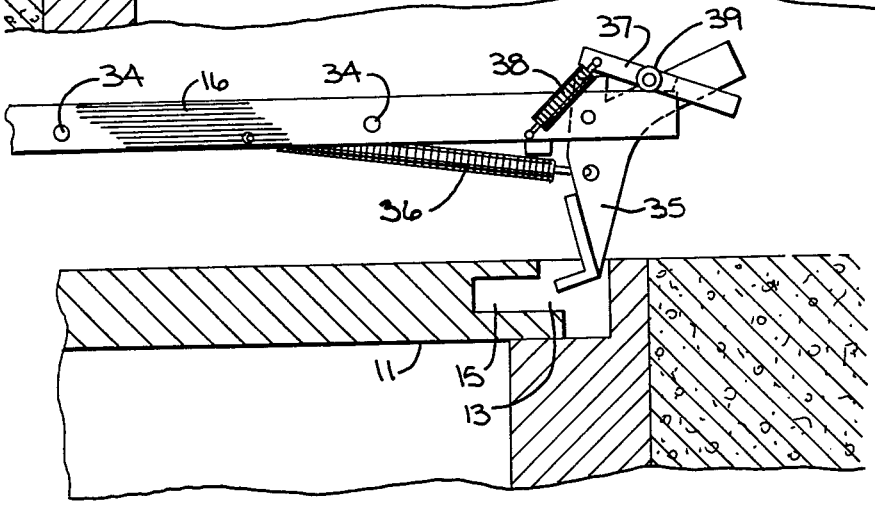
FIG.6
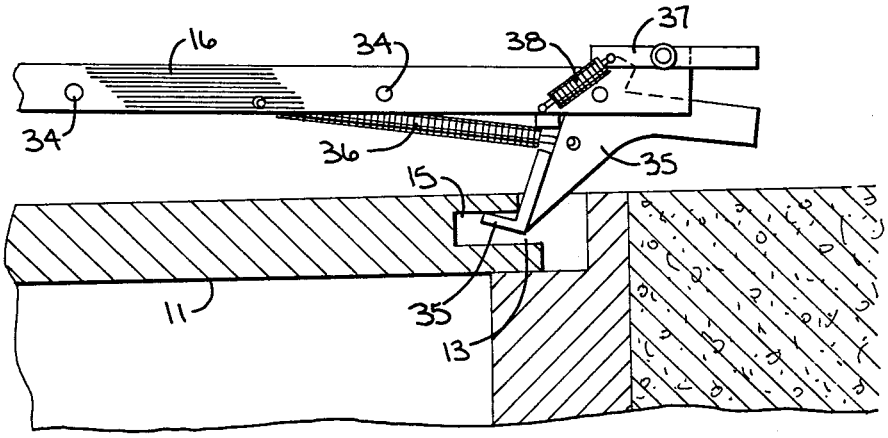
FIG.7
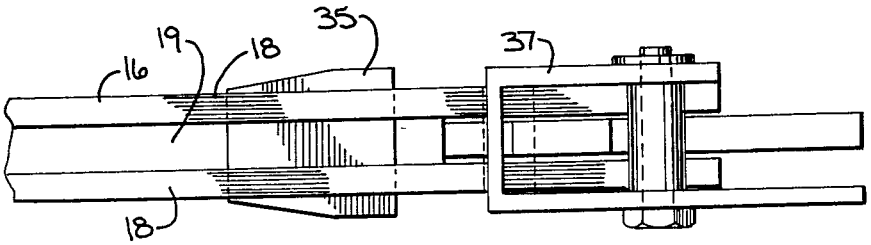
FIG.8

MANHOLE LID LIFTER

BACKGROUND OF THE INVENTION

A. Field of the Invention

The present invention relates to a tool suitable for lifting and maneuvering utility access covers. It appears to be especially useful in connection with manhole covers that are formed with no holes that go all the way through the manhole lid.

B. Description of the Art

It is well known that many utility installations (e.g. sewer pipes, electrical cable conduits, and the like) are positioned below ground level. Access to these utility installations is generally achieved by climbing through an entrance hole at the ground level and down a vertically extending access conduit. This access conduit is usually a cylindrical pipe having a diameter large enough to permit a person to gain access to the utility installation. Such access conduits are commonly called "manholes".

The access conduit entrance is invariably provided with a cover (the manhole lid). For safety, security and durability, this lid is usually fabricated from a rigid material such as cast iron. As a result, it is very heavy and difficult to lift.

Primarily to prevent rainwater and dirt from entering the access conduit, many of the manhole covers which are now being manufactured do not have any holes that go all the way through them. Instead, they are formed with recesses in their top surface at the 6 o'clock and the 12 o'clock positions of the outer circumferential edge of the cover.

One technique that has been tried for lifting or maneuvering these very heavy covers includes the use of crow bars (or similar rod-like tools) which are inserted into one of these recesses. This relies on friction between the cover and the tool to affect the lifting of the cover. Alternatively, the cover may be removed by forcing the cover out of its support ring by jamming such a tool between the outer edge of the cover and the support ring. In both instances, very little control over the movement of the cover can be maintained, and there is a significant risk of injury to the operator.

The art has therefore attempted to develop a better manhole lid lifter. See e.g. U.S. Pat. Nos. 1,933,384, 2,348,978, 2,655,399, 2,832,628, 4,277,731 and 4,365,925. However, none of these devices has lowered the risk of injury to an acceptable level.

SUMMARY OF THE INVENTION

The present invention relates to a tool which is suitable for lifting a manhole lid which has spaced attachment notches. The tool has a substantially rigid support beam. The beam has a first hook adjacent to its forward end which is adapted to be inserted in one of the notches. The beam also has a pivot attachment point adjacent the rear end of the beam.

A second hook is mounted on the pivot attachment point of the beam. It is adapted to be inserted in the second of the spaced notches upon the pivoting of the second hook relative to the beam. The hooks will then act to grip the lid between them. A special catch means is provided to prevent the hook from pivoting back out of the second notch until the catch is released.

In one preferred embodiment of the invention, the handle member is integrally formed with the second hook so as to act as a lever arm around the pivot attachment point, and the catch means automatically locks the second hook in the second notch upon movement of the second hook into the notch.

In another preferred embodiment, the catch means comprises a transverse slot formed across the top surface of the beam, and a bar pivotably connected to the upper end of the second hook and slidably connected to the beam. Pivoting of the second hook into the second notch causes the bar to slide along the top surface of the beam and drop into the slot.

In still another embodiment, the catch means is a loop that drops in front of the top end of the second hook upon pivoting the second hook into the second notch.

It will be appreciated that the present invention provides a means whereby a user can slip a first hook into one of the notches of a manhole lid, and then pivot a second hook until this hook catches under the second notch. When this happens, an automatic catch will hold the hooks in the gripping position. A handle can then be used to pull the lid out of its hole. Because of the secure grip and the rigid nature of the beam, there will be much less risk of the lid becoming uncontrollable. Further, when the lid is to be released, the user can easily disengage the catch means.

The objects of the invention therefore include:

(a) providing a manhole lid lifter of the above kind which minimizes the risk of injury from lifting manhole lids;

(b) providing a manhole lid lifter of the above kind which has an automatic catch that locks the lid to the lifter; and (c) providing a manhole lid lifter of the above kind which is comprised of few parts, and is relatively inexpensive to manufacture.

These and still other objects and advantages of the invention will be apparent from the description which follows. In the following description, the preferred embodiments of the invention will be disclosed with reference to the accompanying drawings. These embodiments do not represent the full scope of the invention, but rather the invention may be employed in other embodiments. Reference is therefore made to the claims herein for interpreting the scope of the present invention.

BRIEF DESCRIPTION OF THE DRAWINGS

FIG. 5 is a front elevational view of a second embodiment of the present invention;

FIG. 6 is a view similar to FIG. 2, but of a portion of the FIG. 5 embodiment;

FIG. 7 is a view similar to FIG. 3, but of a portion of the FIG. 5 embodiment; and FIG. 8 is a view similar to FIG. 4, but of a portion of the FIG. 5 embodiment.

DESCRIPTION OF THE PREFERRED EMBODIMENTS

Figure 1:
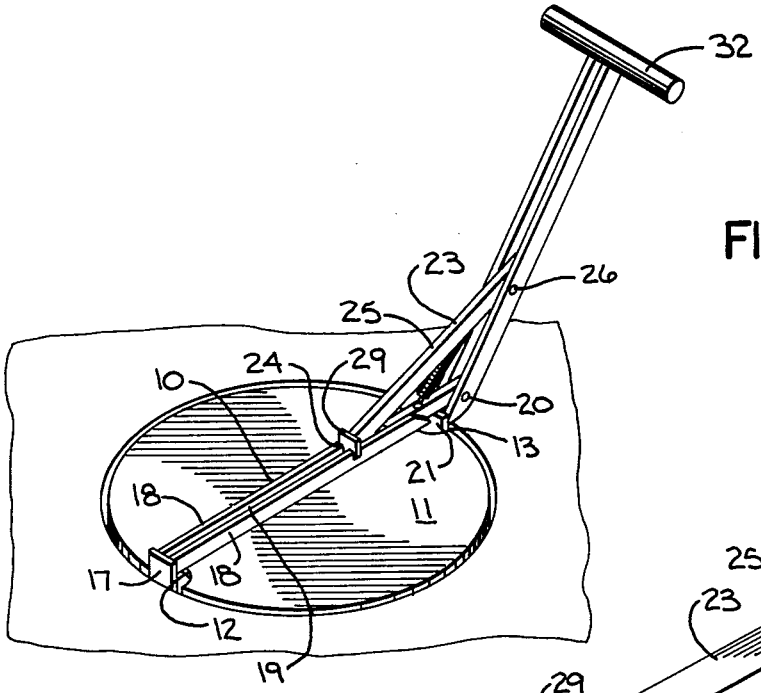
FIG. 1 is a perspective view of a manhole lid lifter embodying the present invention which is being used to lift a manhole lid.

Referring now to FIGS. 1–4 of the drawings, it can be seen that there is a manhole lifter, referred to generally by the numeral 10, which is suitable for lifting a manhole lid 11. The lid has a first notch 12 at what might be deemed the 6 o'clock position on the outer circumference of the lid, and a second notch 13 at what might be deemed the 12 o'clock position of the outer circumference of the lid. Each of these notches is formed with a horizontal undercut or recess 15.

The tool 10 has a substantially rigid support beam 16 and a hook 17 is formed adjacent to the beam's forward end. The hook 17 is adapted to be inserted into the first notch 12 so as to fit in the recess 15. As can best be seen in FIGS. 1–4, the beam 16 is preferably two parallel support beams 18 separated by a central channel 19.

At the other or rear end of the beam, there is a pivot point 20. A second hook 21 is mounted on the beam 16 at this point. The hook 21 is adapted to be inserted in the second notch 13. Upon a pivoting of the hook 21 relative to the beam 16, the hooks will then act to grip the lid between them (compare FIGS. 2 and 3).

To prevent the hooks from releasing the cover at an inopportune moment, a problem which has been of substantial concern to the art for many years, there is provided a catch means 23. In FIGS. 1–4, this comprises a transverse slot 24 formed across the top surface of the beams 18, and a bar 25 pivotally connected to an upper end of the second hook at point 26. The bar 25 is slidably connected to the beam through leg 27. This leg 27 extends between the beams 18 in the channel 19, and a foot of leg 27 catches under the beams 18.

Figure 2:
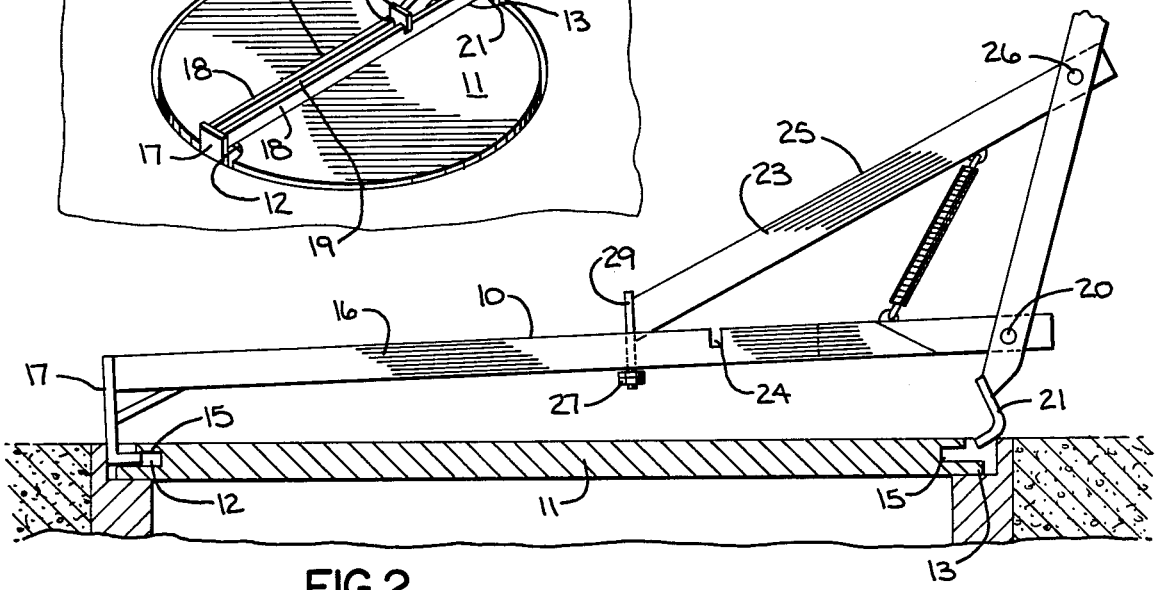
FIG. 2 is a side elevational view of the lower portion of the manhole lid lifter, before it has become completely engaged with the lid.
Figure 3:
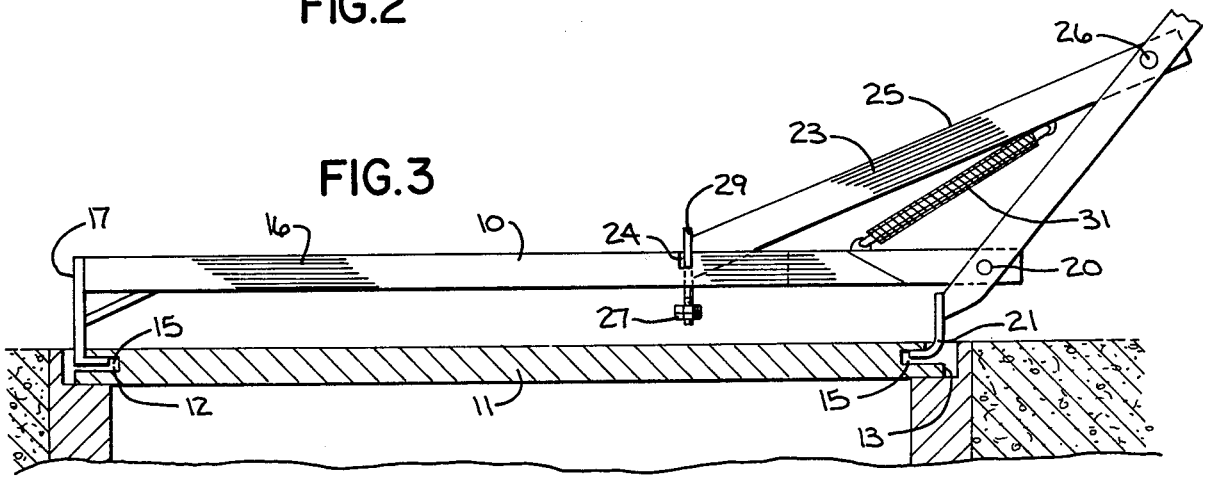
FIG. 3 is a side elevational view, similar to FIG. 2, showing the lid lifter fully engaged with the lid.
Figure 4:
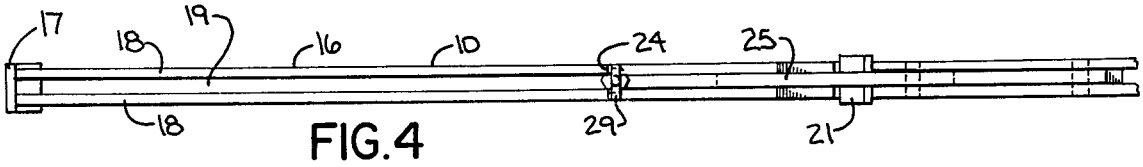
FIG. 4 is a top view of the lid lifter of FIG. 3.

When the lifter is in the position shown in FIG. 2, lip 29 of bar 25 will sit on top of beams 18, and the foot of leg 27 will abut against the underside of the beams 18. The lip 29 will then be free to slide along the top of the beams 18 as the leg 27 moves in the channel 19. Upon a pivoting of the second hook 21 into the second notch 13, the lip 29 will be slid along the beams 18 until it drops into the slot 24. At this point, the foot of leg 27 will drop down to the position shown in FIG. 3. Spring 31 stretches between the bar 25 and one or more of the beams 18 to bias the lip 29 into the slot 24. It will be appreciated that what has just been described is an automatic catch means.

As shown in FIG. 1, there is a handle member 32 that is integrally formed with the second hook 21 so as to act as a lever arm. This allows automatic locking without the user having to bend over. To release the lock, the user need only pull up on bar 25 against the tension of spring 31, and then tilt the handle 32 forward. The lifter 10 is then released from the cover 11.

A second embodiment of the present invention is shown in FIGS. 5–8. It should be noted that while no handle is shown in these drawings, a conventional form of handle will usually be attached at points 34 by suitable screws.

As before, there is a first hook 17 that goes into the first notch 12. However, in this case, the pivoting second hook 35 is normally biased into the gripping position by spring 36. To prevent the weight of the lid 11 from causing the hook 35 to move back out of the second notch, there is a safety loop 37 which drops down in front of the top edge of the hook 35 as the hook moves into its locking position (compare FIGS. 6 and 7).

The loop 37 is normally biased into its catching position by spring 38. However, when it is desired to release the catch means, the loop can be pivoted around point 39 to the position shown in FIG. 6, thus releasing the safety and allowing hook 35 to be moved out of its gripping position.

It will thus be appreciated that the present invention provides an inexpensive and secure means for lifting manhole lids. While the present invention is shown in only two embodiments, it should be appreciated there may be other modifications which are within the scope of the invention. For example, there may be various other catch mechanisms besides the two that have been shown. Also, the hooks need not be placed at the very ends of the beam. These and other modifications are meant to be within the scope of the invention, and thus the illustrative embodiments described above are not meant to limit the claims.

I claim:

1. A tool which is suitable for lifting a manhole lid which has spaced attachment notches, the tool comprising:

a substantially rigid support beam;

said beam having a first hook adjacent to its forward end which is adapted to be inserted in one of the notches;

said beam also having a pivot attachment point adjacent the rear end of the beam;

a second hook mounted on the pivot attachment point, said second hook being adapted to be inserted in a second of said notches upon a pivoting of the hook relative to the beam, said hooks then acting to grip the lid between them; and a catch means which prevents the second hook from pivoting back out of the second notch until the catch is released, said catch means automatically activating and locking the second hook in the second notch upon a pivotal movement of the second hook into the second notch.

2. The tool of claim 1, wherein a handle member is integrally formed with the second hook so as to act as a lever arm.

3. The tool of claim 1, wherein the catch means comprises:

a transverse slot formed across a top surface of the beam; and a bar pivotably connected to an upper end of the second hook, and slidably connected to the beam, whereby pivoting of the second hook into the second notch causes the bar to slide along the top surface of the beam and drop into the slot.

4. The tool of claim 3, wherein a spring is stretched between the bar and beam to bias an end of the bar into the slot.

5. The tool of claim 1, wherein the catch means comprises a loop that drops in front of a top end of the second hook upon a pivoting of the second hook into the second notch.

* * * * *